US009818358B2

(12) United States Patent
Chen et al.

(10) Patent No.: US 9,818,358 B2
(45) Date of Patent: Nov. 14, 2017

(54) SCANNING DRIVING CIRCUIT AND THE LIQUID CRYSTAL DISPLAY APPARATUS WITH THE SCANNING DRIVING CIRCUIT THEREOF

(71) Applicants: Shenzhen China Star Optoelectronics Technology Co., Ltd., Shenzhen, Guangdong (CN); Wuhan China Star Optoelectronics Technology Co., Ltd., Wuhan, Hubei (CN)

(72) Inventors: Caiqin Chen, Guangdong (CN); Mang Zhao, Guangdong (CN)

(73) Assignees: Shenzhen China Star Optoelectronics Technology Co., Ltd, Shenzhen, Guangdong (CN); Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 122 days.

(21) Appl. No.: 14/888,693

(22) PCT Filed: Sep. 29, 2015

(86) PCT No.: PCT/CN2015/091070

§ 371 (c)(1),
(2) Date: Nov. 2, 2015

(87) PCT Pub. No.: WO2017/049661

PCT Pub. Date: Mar. 30, 2017

(65) Prior Publication Data

US 2017/0169781 A1 Jun. 15, 2017

(30) Foreign Application Priority Data

Sep. 23, 2015 (CN) ..... 2015 1 0613607

(51) Int. Cl.
*G09G 3/36* (2006.01)

(52) U.S. Cl.
CPC ... *G09G 3/3677* (2013.01); *G09G 2300/0809* (2013.01); *G09G 2310/0243* (2013.01); *G09G 2310/08* (2013.01)

(58) Field of Classification Search
CPC ..... G09G 2330/021; G09G 3/36
See application file for complete search history.

(56) References Cited

U.S. PATENT DOCUMENTS 7,696,972 B2 4/2010 Tseng et al.
2010/0303195 A1 12/2010 Wang
(Continued)

FOREIGN PATENT DOCUMENTS

CN 104269145 A 1/2015
CN 104681000 A 3/2015

*Primary Examiner* — Olga Merkoulova
(74) *Attorney, Agent, or Firm* — Andrew C. Cheng

(57) ABSTRACT

The invention provides a scanning driving circuit and a liquid crystal display apparatus. The scanning driving circuit including a latch module to receive and calculate an upper level control signal, a first and a second clock signal and a reset signal to get a first control signal, and latch and output the first control signal; a logic control module receive and calculate the first and the second control signal and the third clock signal to get a logic control signal, and output the logic control signal; an output module receive and calculate the logic control signal and the second control signal to get and output a scanning driving signal, and a scan line connected to the output module to transmit the scanning driving signal to a pixel unit and to achieve the special function of the liquid crystal display apparatus.

20 Claims, 4 Drawing Sheets

(56) References Cited

U.S. PATENT DOCUMENTS

| | | | | |
|---|---|---|---|---|
| 2011/0228893 | A1* | 9/2011 | Tobita | G11C 19/184 377/77 |
| 2015/0228354 | A1 | 8/2015 | Qing et al. | |
| 2016/0365050 | A1 | 12/2016 | Qing et al. | |
| 2017/0039968 | A1* | 2/2017 | Chen | G09G 3/3648 |

* cited by examiner

SCANNING DRIVING CIRCUIT AND THE LIQUID CRYSTAL DISPLAY APPARATUS WITH THE SCANNING DRIVING CIRCUIT THEREOF

FIELD OF THE INVENTION

The present invention relates to a display technology, and particularly to a scanning driving circuit and the liquid crystal display apparatus with the scanning driving circuit thereof.

BACKGROUND OF THE INVENTION

A scanning driving circuit is used in the current liquid crystal display apparatus, so as to form the scanning driving circuit on the transistor array substrate by the thin-film transistor liquid crystal display array process. It can achieve the driving method by scanning each row. The function of the current design of the scanning driving circuit is unique, and cannot achieve the function of open all of the circuit of the scan line and is unfavorable to achieve the special function of the liquid crystal display apparatus.

SUMMARY

The invention for solving the technology problem is to provide a scanning driving circuit and a liquid crystal display apparatus to achieve the function of open all of the scan line and to achieve the special function of the liquid crystal display apparatus.

In order to solve the technology problem mentioned above, the technical approach of this application is providing a scanning driving circuit including:

A latch module to receive an upper level control signal, a first and a second clock signal and a reset signal and perform a calculation to the upper level control signal, the first and the second clock signal and the reset signal to get a first control signal, and latch and output the first control signal;

A logic control module connected to the latch module to receive the first control signal output from the latch module and perform a logic calculation to the first control signal, the second control signal and the third clock signal to get a logic control signal, and output the logic control signal;

An output module connected to the logic control module to receive the logic control signal output from the logic control module and perform a calculation to the logic control signal and the second control signal to get a scanning driving signal, and output the scanning driving signal; and A scan line connected to the output module to transmit the scanning driving signal output from the output module to the pixel unit.

Wherein the latch module comprising: a first to fourth invertor and a controllable switch, the input terminal of the first invertor is connected to the first clock signal, the output terminal of the first invertor is connected to the low electrical level terminal of the second invertor, the second clock signal and the high electrical level terminal of the third invertor, the input terminal of the second invertor is connected to the upper level control signal, the high electrical level terminal of the second invertor is connected to the input terminal of the first invertor and the low electrical level terminal of the third invertor, the input terminal of the third inventor is connected to the said level control signal, the control terminal of the controllable switch is connected to the reset signal, the input terminal of the controllable switch is connected to the open voltage terminal, the output terminal of the controllable switch is connected to the output terminal of the second invertor and the input terminal of the fourth invertor, the output terminal of the fourth invertor is connected to the input terminal of the third invertor and the logic control module.

Wherein the logic control module comprising: a second to seventh controllable switch, the control terminal of the second controllable switch is connected to the second control signal and the control terminal of the seventh controllable switch, the input terminal of the second controllable switch is connected to the open voltage terminal, the output terminal of the second controllable switch is connected to the input terminal of the third controllable switch and the input terminal of the fourth controllable switch, the control terminal of the third controllable switch is connected to the output terminal of the fourth invertor and the control terminal of the fifth controllable switch, the output terminal of the third controllable switch is connected to the output module, the output terminal of the fourth controllable switch, the output terminal of the fifth controllable switch and the output terminal of the seventh controllable switch, the control terminal of the fourth controllable switch is connected to the third clock signal, the input terminal of the fifth controllable switch is connected to the output terminal of the sixth controllable switch, the control terminal of the sixth controllable switch is connected to the third clock signal, the input terminal of the sixth controllable switch is connected to the close voltage terminal and the input terminal of the seventh controllable switch.

Wherein the logic control module comprising: a second to seventh controllable switch, the control terminal of the second controllable switch is connected to the output terminal of the fourth invertor and the control terminal of the fifth controllable switch, the input terminal of the second controllable switch is connected to the input terminal of the third controllable switch and the open voltage terminal, the output terminal of the second controllable switch is connected to the output terminal of the third controllable switch and the input terminal of the fourth controllable switch, the control terminal of the third controllable switch is connected to the third clock signal, the control terminal of the fourth controllable switch is connected to the second control signal and the control terminal of the seventh controllable switch, the output terminal of the fourth controllable switch is connected to the output module and the output terminal of the fifth controllable switch and the seventh controllable switch, the input terminal of the fifth controllable switch is connected to the output terminal of the sixth controllable switch, the control terminal of the sixth controllable switch is connected to the third clock signal, the input terminal of the sixth controllable switch is connected to the input terminal of the seventh controllable switch and the close voltage terminal.

Wherein the logic control module comprising: a second to seventh controllable switch, the control terminal of the second controllable switch is connected to the output terminal of the fourth invertor and the control terminal of the sixth controllable switch, the input terminal of the second controllable switch is connected to the input terminal of the third controllable switch and the open voltage terminal, the output terminal of the second controllable switch is connected to the output terminal of the third controllable switch and the input terminal of the fourth controllable switch, the control terminal of the third controllable switch is connected to the third clock signal, the control terminal of the fourth controllable switch is connected to the second control signal and the control terminal of the seventh controllable switch, the output terminal of the fourth controllable switch is connected to the output module, and the output terminal of the fifth controllable switch and the seventh controllable switch, the input terminal of the fifth controllable switch is connected to the output terminal of the sixth controllable switch, the control terminal of the fifth controllable switch is connected to the third clock signal, the input terminal of the sixth controllable switch is connected to the input terminal of the seventh controllable switch and the close voltage terminal.

Wherein the logic control module comprising: a second to seventh controllable switch, the control terminal of the second controllable switch is connected to the second control signal and the control terminal of the seventh controllable switch, the input terminal of the second controllable switch is connected to the open voltage terminal, the output terminal of the second controllable switch is connected to the input terminal of the third controllable switch and the input terminal of the fourth controllable switch, the control terminal of the third controllable switch is connected to the output terminal of the fourth invertor and the control terminal of the sixth controllable switch, the output terminal of the third controllable switch is connected to the output module, the output terminal of the fourth controllable switch, the output terminal of the fifth controllable switch and the seventh controllable switch, the control terminal of the fourth controllable switch is connected to the third clock signal, the input terminal of the fifth controllable switch is connected to the output terminal of the sixth controllable switch, the control terminal of the fifth controllable switch is connected to the third clock signal, the input terminal of the sixth controllable switch is connected to the close voltage terminal and the input terminal of the seventh controllable switch.

Wherein the output module comprising: a fifth to seventh invertor, the input terminal of the fifth invertor is connected to the output terminal of the fifth controllable switch and the seventh controllable switch, the output terminal of the fifth invertor is connected to the input terminal of the sixth invertor, the output terminal of the sixth invertor is connected to the input terminal of the seventh invertor, and the output terminal of the seventh invertor is connected to the scan line.

Wherein the logic control module comprising: a second to fifth controllable switch, the control terminal of the second controllable switch is connected to the output terminal of the fourth invertor and the control terminal of the fourth controllable switch, the input terminal of the second controllable switch is connected to the input terminal of the third controllable switch and the open voltage terminal, the output terminal of the second controllable switch is connected to the output module, the output terminal of the third controllable switch and the fourth controllable switch, the control terminal of the third controllable switch is connected to the third clock signal and the control terminal of the fifth controllable switch, the input terminal of the fourth controllable switch is connected to output terminal of the fifth controllable switch, the input terminal of the fifth controllable switch is connected to the close voltage terminal.

Wherein the output module comprising: a fifth and a sixth invertor and a NOR gate, the input terminal of the fifth invertor is connected to the output terminal of the fourth controllable switch, the output terminal of the fifth invertor is connected to the first input terminal of the NOR gate, the second input terminal of the NOR gate is connected to the second control signal, the output terminal of the NOR gate is connected to the input terminal of the sixth invertor and the input terminal of the sixth invertor is connected to the scan line.

In order to solve the technology problem mentioned above, the technical approach of this application is providing liquid crystal display apparatus having a scanning driving circuit described above.

The advantage of this application is to make distinguish of the conventional technology. The scanning driving circuit performs logic calculation of the first control signal and the third clock signal output from the latch module in the logic control module. In the working period of the second control signal, no matter how the electrical level of the first control signal and the third clock signal is changed, a high electrical level scanning driving signal is output from the output module to achieve the function of opening all the scan line and achieve the special function of the liquid crystal display apparatus.

DETAILED DESCRIPTION

In order to make the structure and characteristics as well as the effectiveness of the present invention to be further understood and recognized, the detailed description of the present invention is provided as follows along with embodiments and accompanying figures.

Figure 1:
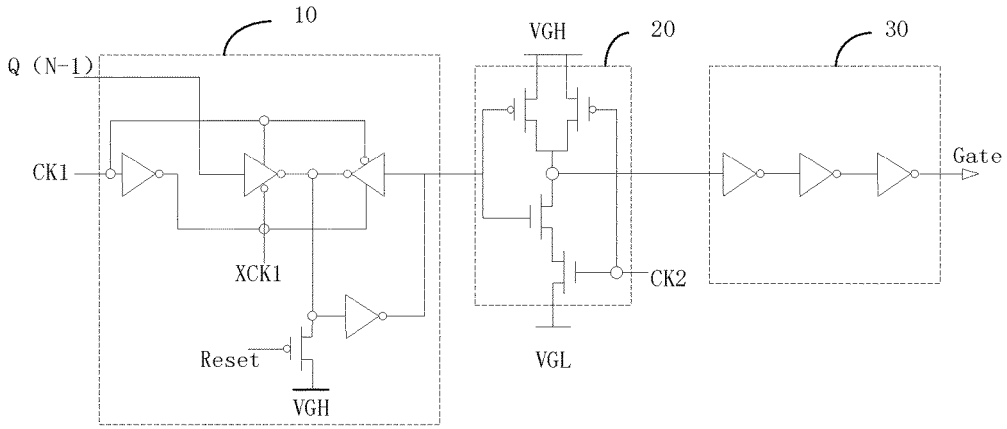
FIG 1 (Prior Art)
FIG. 1 is a schematic structural view of a conventional scanning driving circuit.

Referring to FIG. 1, FIG. 1 is a schematic structural view of a conventional scanning driving circuit. As shown in the FIG. 1, the logic control module 20 in the conventional scanning driving circuit includes four controllable switches to receive the first control signal output from the latch module 10 and receive the third clock signal. By calculating the signals, it can output the high electrical level or low electrical level scanning driving signal to a scan line. In other word, as shown in FIG. 1, when the latch module 10 output a first control signal and the third clock signal received by the logic control module 20 is changed, the scanning driving signal output from the output module 30 is changed, so the function of open of the scan line cannot be achieved and not favor to achieve the special function of the liquid crystal display apparatus.

Figure 2:
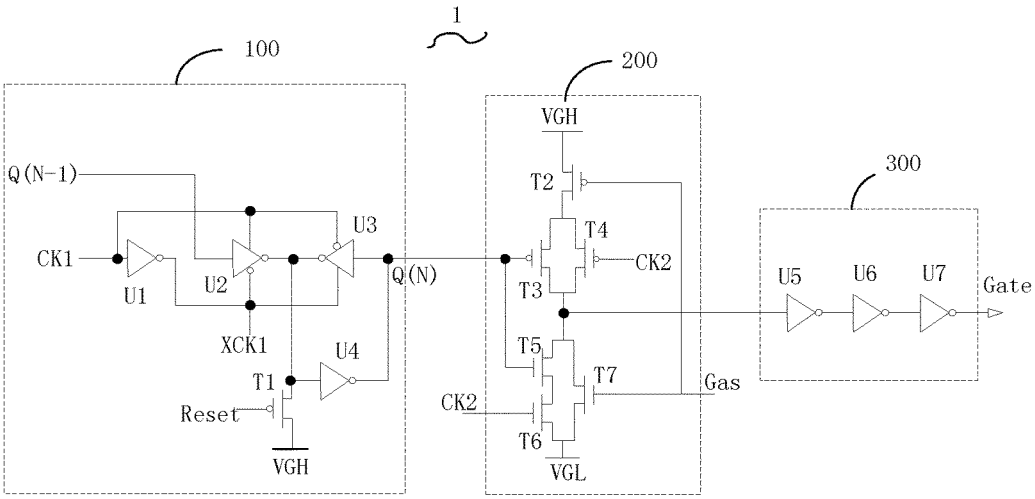
FIG. 2 is a schematic structural view of a scanning driving circuit according the first embodiment of the present invention.

Referring to FIG. 2, FIG. 2 is a schematic structural view of a scanning driving circuit according the first embodiment of the present invention. As shown in FIG. 2, the scanning driving circuit 1 of this invention includes a latch module 100 to receive an upper level control signal, a first and a second clock signal and a reset signal, calculate the upper level control signal, the first and the second clock signal and the reset signal to get a first control signal, and to latch and output the first control signal. A logic control module 200 is connected to the latch module 100 and to receive the first control signal output from the latch module 100 and perform a logic calculation of the first control signal, a second control signal and the third clock signal to receive a logic control signal and output the logic control signal. An output module 300 is connected to the logic control module 200 to receive the logic control signal output from logic control module 200 and perform a calculation the logic control signal and the and the second control signal to get and output a scanning driving signal. A scan line is connected to the output module 300 to transmit the scanning driving signal from the output module 300 to the pixel unit.

The latch module 100 includes a first to fourth invertor U1-U4 and a controllable switch T1, the input terminal of the first invertor U1 is connected to the first clock signal, the output terminal of the first invertor U1 is connected to the low electrical level terminal of the second invertor U2, the second clock signal and the high electrical level terminal of the third invertor U3. The input terminal of the second invertor U2 is connected to the upper level control signal, the high electrical level terminal of the second invertor U2 is connected to the input terminal of the first invertor U1 and the low electrical level terminal of the third invertor U3. The output terminal of the second inventor U2 is connected to the output terminal of the third inventor U3. The input terminal of the third inventor U3 is connected to the said level control signal. The control terminal of the controllable switch T1 is connected to the reset signal, the input terminal of the controllable switch T1 is connected to the open voltage terminal VGH, the output terminal of the controllable switch T1 is connected to the output terminal of the second invertor U2 and the input terminal of the fourth invertor U4. The output terminal of the fourth invertor U4 is connected to the input terminal of the third invertor U3 and the logic control module 200. In this embodiment, the first controllable switch T1 is a PMOS thin-film transistor.

The logic control module 200 includes a second to seventh controllable switch T2-T7. The control terminal of the second controllable switch T2 is connected to the second control signal and the control terminal of the seventh controllable switch T7. The input terminal of the second controllable switch T2 is connected to the open voltage terminal VGH, the output terminal of the second controllable switch T2 is connected to the input terminal of the third controllable switch T3 and the fourth controllable switch T4. The control terminal of the third controllable switch T3 is connected to the output terminal of the fourth invertor U4 and the control terminal of the fifth controllable switch T5, the output terminal of the third controllable switch T3 is connected to the output module 300, the output terminal of the fourth controllable switch T4, and the output terminal of the fifth controllable switch T5 and the seventh controllable switch T7. The control terminal of the fourth controllable switch T4 is connected to the third clock signal. The input terminal of the fifth controllable switch T5 is connected to the output terminal of the sixth controllable switch T6. The control terminal of the sixth controllable switch T6 is connected to the third clock signal. The input terminal of the sixth controllable switch T6 is connected to the close voltage terminal VGL and the input terminal of the seventh controllable switch T7.

The output module 300 includes a fifth to seventh invertor U5-U7. The input terminal of the fifth invertor U5 is connected to the output terminal of the fifth controllable switch T5 and the seventh controllable switch T7. The output terminal of the fifth invertor U5 is connected to the input terminal of the sixth invertor U6. The output terminal of the sixth invertor U6 is connected to the input terminal of the seventh invertor U7 and the output terminal of the seventh invertor U7 is connected to the scan line.

Figure 3:
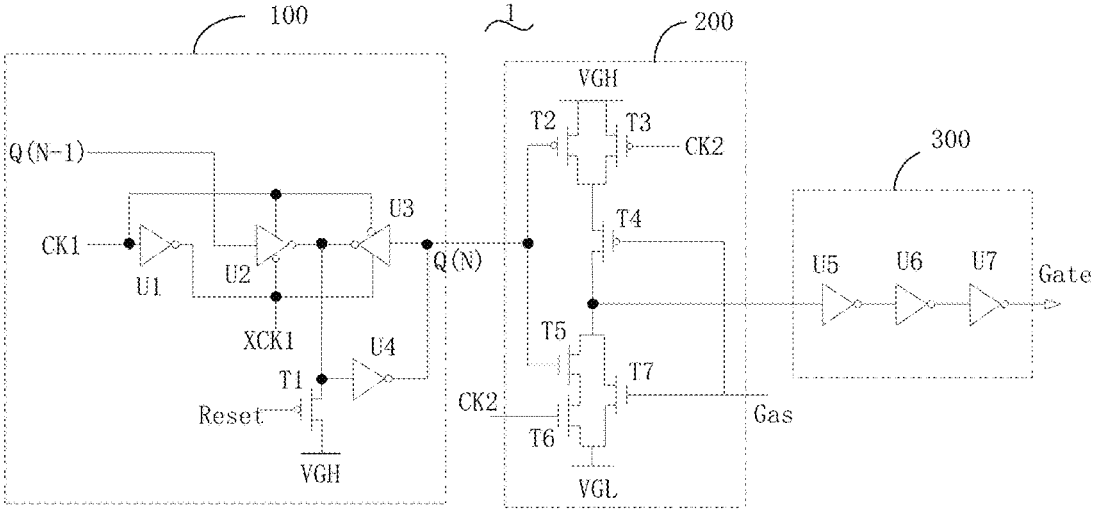
FIG. 3 is a schematic structural view of a scanning driving circuit according the second embodiment of the present invention.
Figure 4:
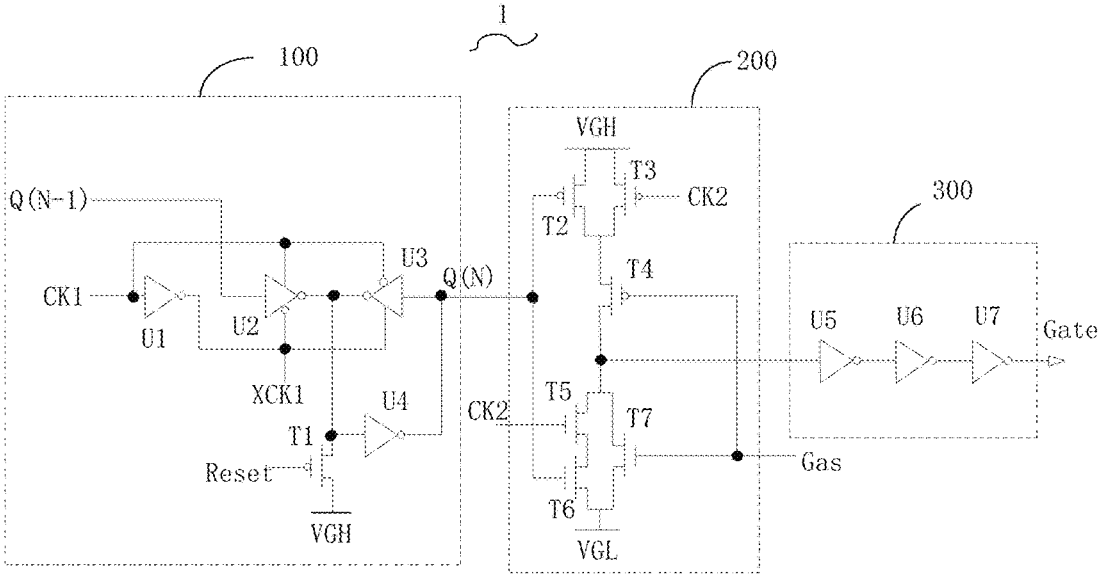
FIG. 4 is a schematic structural view of a scanning driving circuit according the third embodiment of the present invention.
Figure 5:
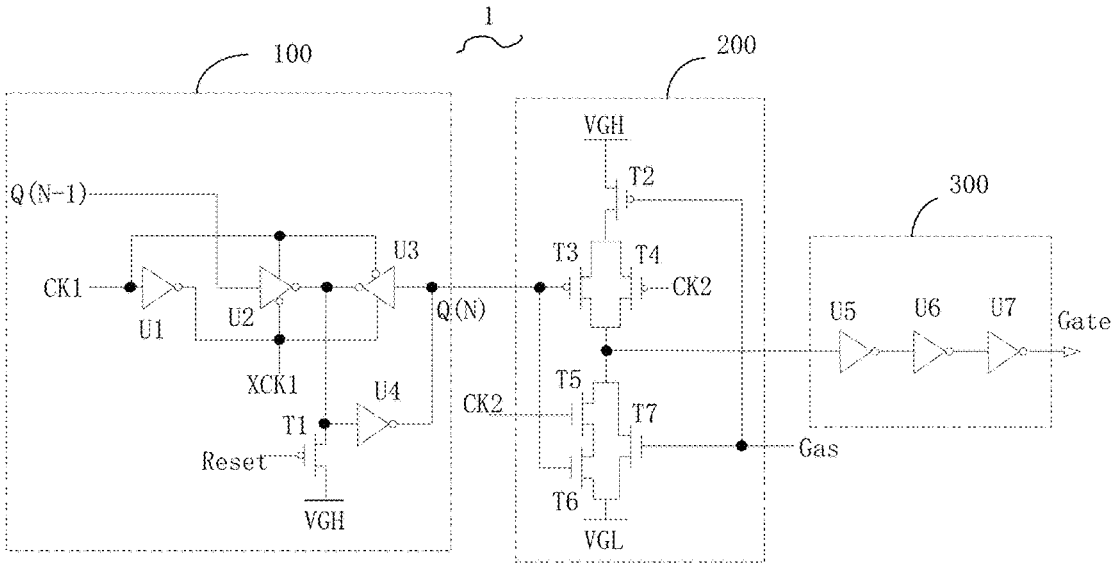
FIG. 5 is a schematic structural view of a scanning driving circuit according the fourth embodiment of the present invention.

Referring to FIG. 3, FIG. 3 is a schematic structural view of a scanning driving circuit according the second embodiment of the present invention. As shown in the FIG. 3, the difference between the scanning driving circuit of the first embodiment and the scanning driving circuit of the second embodiment is as followed. The logic control module 200 includes a second to seventh controllable switch T2-T7. The control terminal of the second controllable switch T2 is connected to the output terminal of the fourth invertor U4 and the control terminal of the fifth controllable switch T5. The input terminal of the second controllable switch T2 is connected to the input terminal of the third controllable switch T3 and the open voltage terminal VGH, the output terminal of the second controllable switch T2 is connected to the output terminal of the third controllable switch T3 and the input terminal of the fourth controllable switch T4. The control terminal of the third controllable switch T3 is connected to the third clock signal. The control terminal of the fourth controllable switch T4 is connected to the second control signal and the control terminal of the seventh controllable switch T7. The output terminal of the fourth controllable switch T4 is connected to the output module 300 and the output terminal of the fifth controllable switch T5 and the seventh controllable switch T7. The input terminal of the fifth controllable switch T5 is connected to the output terminal of the sixth controllable switch T6. The control terminal of the sixth controllable switch T6 is connected to the third clock signal. The input terminal of the sixth controllable switch T6 is connected to the input terminal of the seventh controllable switch T7 and the close voltage terminal VGL. Referring to FIG. 4, FIG. 4 is a schematic structural view of a scanning driving circuit according the third embodiment of the present invention. As shown in FIG. 4, the difference between the scanning driving circuit of the third embodiment and the scanning driving circuit of the first embodiment is as followed. The logic control module 200 includes a second to seventh controllable switch T2-T7. The control terminal of the second controllable switch T2 is connected to the output terminal of the fourth invertor U4 and the control terminal of the sixth controllable switch T6. The input terminal of the second controllable switch T2 is connected to the input terminal of the third controllable switch T3 and the open voltage terminal VGH, the output terminal of the second controllable switch T2 is connected to the output terminal of the third controllable switch T3 and the input terminal of the fourth controllable switch T4. The control terminal of the third controllable switch T3 is connected to the third clock signal. The control terminal of the fourth controllable switch T4 is connected to the second control signal and the control terminal of the seventh controllable switch T7. The output terminal of the fourth controllable switch T4 is connected to the output module 300 and the output terminal of the fifth controllable switch T5 and the seventh controllable switch T7. The input terminal of the fifth controllable switch T5 is connected to the output terminal of the sixth controllable switch T6. The control terminal of the fifth controllable switch T5 is connected to the third clock signal. The input terminal of the sixth controllable switch T6 is connected to the input terminal of the seventh controllable switch T7 and the close voltage terminal VGL. Referring to FIG. 5, FIG. 5 is a schematic structural view of a scanning driving circuit according the fourth embodiment of the present invention. As shown in FIG. 5, the difference between the scanning driving circuit of the fourth embodiment and the scanning driving circuit of the first embodiment is as followed. The logic control module 200 includes a second to seventh controllable switch T2-T7. The control terminal of the second controllable switch T2 is connected to the second control signal and the control terminal of the seventh controllable switch T7. The input terminal of the second controllable switch T2 is connected to the open voltage terminal VGH, the output terminal of the second controllable switch T2 is connected to the input terminal of the third controllable switch T3 and the fourth controllable switch T4. The control terminal of the third controllable switch T3 is connected to the output terminal of the fourth invertor U4 and the control terminal of the sixth controllable switch T6. The output terminal of the third controllable switch T3 is connected to the output module 300, the output terminal of the fourth controllable switch T4, the output terminal of the fifth controllable switch T5 and the seventh controllable switch T7. The control terminal of the fourth controllable switch T4 is connected to the third clock signal. The input terminal of the fifth controllable switch T5 is connected to the output terminal of the sixth controllable switch T6. The control terminal of the fifth controllable switch T5 is connected to the third clock signal. The input terminal of the sixth controllable switch T6 is connected to the close voltage terminal VGL and the input terminal of the seventh controllable switch T7.

In the first to the fourth embodiments, the second to the fourth controllable switch T2-T4 are PMOS thin-film transistors, and the fifth to the seventh controllable switch T5-T7 are NMOS thin-film transistors.

The working theories of the scanning driving circuit in first to the fourth embodiments are as followed.

No matter how the electric potential of the first clock signal, the second clock signal or the reset signal is received by the latch module 100,no matter how the electric potential of the first control signal output from the latch module 100, and no matter how the electric potential of the third clock signal received by the logic control module 200. When the second control signal is a high electrical level signal, the seventh controllable switch T7 is open. Because the input terminal of the seventh controllable switch T7 is connected to the close voltage terminal VGL that is in a low electric potential the output terminal of the seventh controllable switch T7 is output a low electrical level signal to the output module 300. The output module 300 will receive a low electrical level signal and a high electrical level of the scanning driving signal calculated by the fifth to the seventh investors is output to the scan line, and the function to open all the scan line are achieved.

Figure 6:
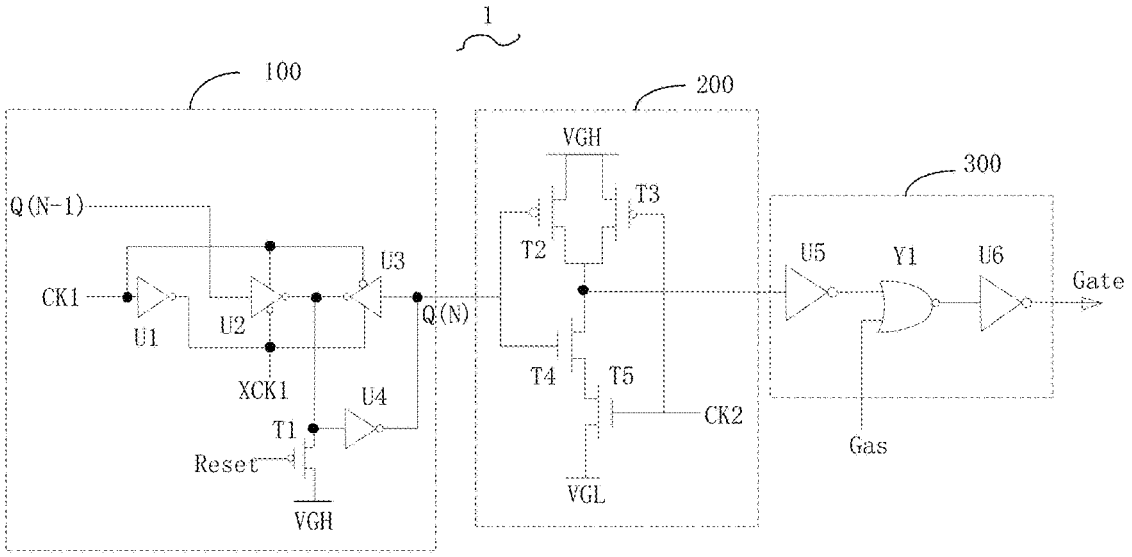
FIG. 6 is a schematic structural view of a scanning driving circuit according the fifth embodiment of the present invention.

Referring to FIG. 6, FIG. 6 is a schematic structural view of a scanning driving circuit according the fifth embodiment of the present invention. As shown in FIG. 6, the difference between the scanning driving circuit of the fifth embodiment and the scanning driving circuit of the first embodiment is as followed. The logic control module 200 includes a second to fifth controllable switch T2-T5. The control terminal of the second controllable switch T2 is connected to the output terminal of the fourth invertor U4 and the control terminal of the fourth controllable switch T4. The input terminal of the second controllable switch T2 is connected to the input terminal of the third controllable switch T3 and the open voltage terminal VGH. The output terminal of the second controllable switch T2 is connected to the output module 300, the output terminal of the third controllable switch T3 and the fourth controllable switch T4. The control terminal of the third controllable switch T3 is connected to the third clock signal and the control terminal of the fifth controllable switch T5. The input terminal of the fourth controllable switch T4 is connected to output terminal of the fifth controllable switch T5. The input terminal of the fifth controllable switch T5 is connected to the close voltage terminal VGL. In this embodiment, the second and the third controllable switch T2, T3 are PMOS thin-film transistors, and the fourth and the fifth controllable switch T4, T5 are NMOS thin-film transistors. The output module 300 in this embodiment further includes a fifth and a sixth invertor U5, U6 and a NOR gate Y1. The input terminal of the fifth invertor U5 is connected to the output terminal of the fourth controllable switch T4. The output terminal of the fifth invertor U5 is connected to the first input terminal of the NOR gate Y1. The second input terminal of the NOR gate Y1 is connected to the second control signal. The output terminal of the NOR gate Y1 is connected to the input terminal of the sixth invertor U6 and the input terminal of the sixth invertor U6 is connected to the scan line.

The working theory of the scanning driving circuit of the fifth embodiment is as followed. No matter how the electric potential of the first clock signal, the second clock signal or the reset signal is received by the latch module 100, no matter how the electric potential of the first control signal output from the latch module 100, and no matter how the electric potential of the third clock signal received by the logic control module 200. When a high electrical level signal is output from the logic control module 200, the high electrical level signal is passing through the fifth invertor U5 of the output module 300 and a low electrical level signal is output to the first input terminal of the NOR gate Y1. The second control signal outputs a high electrical level signal to the second input terminal of the NOR gate Y1, a low electrical level signal is output to the input terminal of the sixth invertor U6 by the NOR gate Y1 after the NOR operation. A high electrical level scanning driving signal is output from the sixth invertor U6 to the scan line to achieve the function of opening all the scan line. If a low electrical level signal is output from the logic control module 200, the low electrical level signal is passing through the fifth invertor U5 of the output module 300 and a high electrical level signal is output to the first input terminal of the NOR gate Y1. The second control signal Gas outputs a high electrical level signal to the second input terminal of the NOR gate Y1, a low electrical level signal is output to the input terminal of the sixth invertor U6 by the NOR gate Y1 after the NOR operation. A high electrical level scanning driving signal is output from the sixth invertor U6 to the scan line to achieve the function of opening all the scan line.

Figure 7:
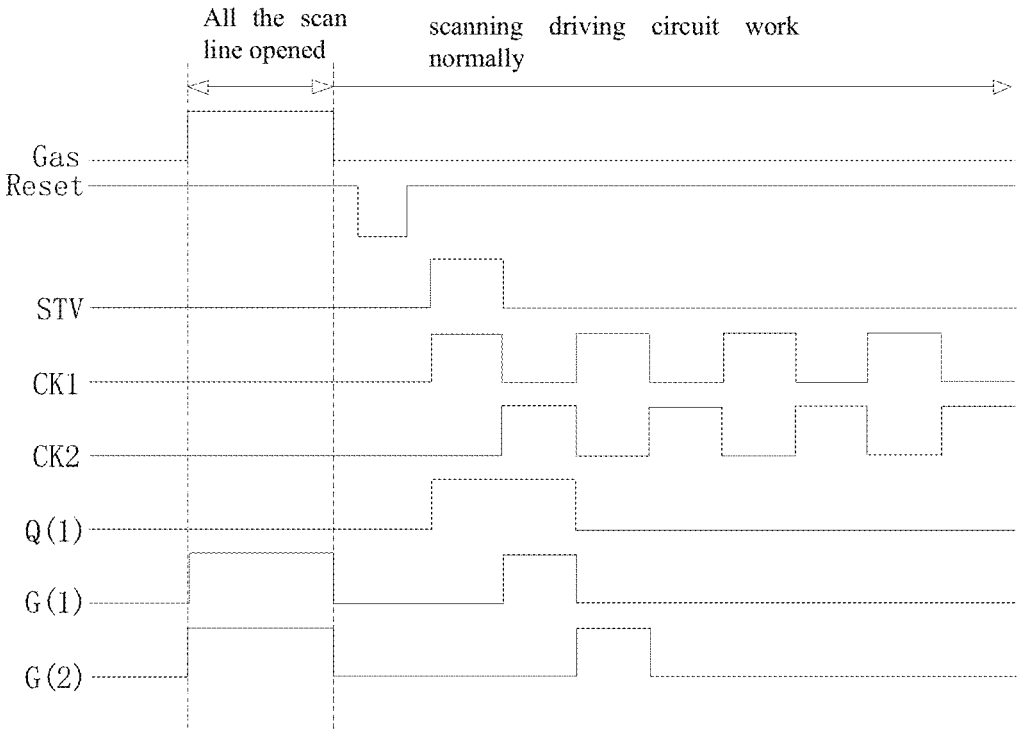
FIG. 7 shows waveforms of the scanning driving signals according an embodiment of the present invention.

Referring to FIG. 7, FIG. 7 shows waveforms of the scanning driving signals according an embodiment of the present invention. By analysis of FIG. 7, in the working period of the second control signal, the second control signal is in high electrical level. Whether the first control signal or the third control signal output from the latch module 100 is changed, a high electrical level scanning driving signal is output from the output module 300 to achieve the function of opening all the scan line. When the second control signal is changed to a low electrical level, the scanning driving circuit 1 can normally work.

Only one scanning driving circuit is illustrated as an example in the first to the fifth embodiments, wherein the upper level control signal is an upper level control signal Q (N-1), and the first control signal is a first control signal Q (N). The first clock signal is a first clock signal CK1, the second clock signal is a second clock signal XCK1, the reset signal is a reset signal Reset, the third clock signal is a third clock signal CK2, the second control signal is a second control signal Gas, and the scan line is a scan line Gate.

Figure 8:
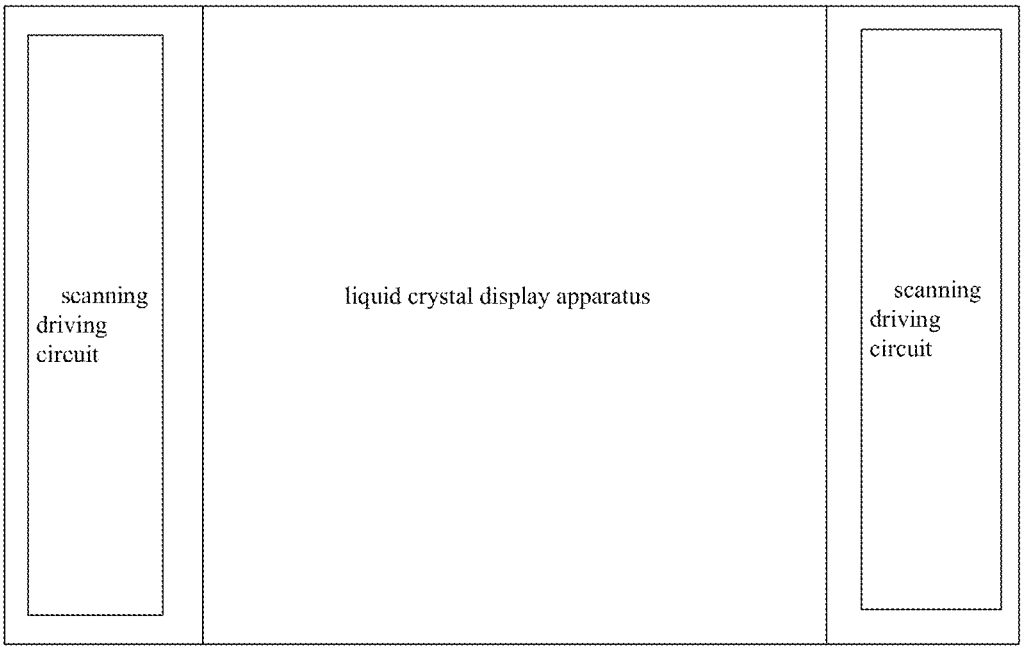
FIG. 8 is a schematic structural view of a liquid crystal display apparatus of the embodiment of the present invention.

Referring to FIG. 8, FIG. 8 is a schematic structural view of a liquid crystal display apparatus of the embodiment of the present invention. The liquid crystal display apparatus includes the scanning driving circuit 1 and the scanning driving circuit 1 is in the two ends of the liquid crystal display apparatus.

The first control signal and the third clock signal output from the latch module are performed logic calculation in the logic control module in the scanning driving circuit 1. In the working period of the second control signal, no matter how the electrical level of the first control signal and the third clock signal is changed, a high electrical level scanning driving signal is output from the output module to achieve the function of opening all the scan line and achieve the special function of the liquid crystal display apparatus.

Accordingly, the present invention conforms to the legal requirements owing to its novelty, non-obviousness, and utility. However, the foregoing description is only embodiments of the present invention, not used to limit the scope and range of the present invention. Those equivalent changes or modifications made according to the shape, structure, feature, or spirits described in the claims of the present invention are included in the appended claims of the present invention.

The invention claimed is:

1. A scanning driving circuit, wherein scanning driving circuit comprising:

a latch module to receive an upper level control signal, a first and a second clock signal and a reset signal and perform a calculation to the upper level control signal, the first and the second clock signal and the reset signal to get a first control signal, and latch and output the first control signal;

a logic control module connected to the latch module to receive the first control signal output from the latch module and perform a logic calculation to the first control signal, the second control signal and the third clock signal to get a logic control signal, and output the logic control signal, wherein the logic control module comprising: a second to fifth controllable switch;

an output module connected to the logic control module to receive the logic control signal output from the logic control module and perform a calculation to the logic control signal and the second control signal to get a scanning driving signal, and output the scanning driving signal; and a scan line connected to the output module to transmit the scanning driving signal output from the output module to the pixel unit.

2. The scanning driving circuit of claim 1, wherein the latch module comprising: a first to fourth invertor and a controllable switch, the input terminal of the first invertor is connected to the first clock signal, the output terminal of the first invertor is connected to the low electrical level terminal of the second invertor, the second clock signal and the high electrical level terminal of the third invertor, the input terminal of the second invertor is connected to the upper level control signal, the high electrical level terminal of the second invertor is connected to the input terminal of the first invertor and the low electrical level terminal of the third invertor, the input terminal of the third inventor is connected to the said level control signal, the control terminal of the controllable switch is connected to the reset signal, the input terminal of the controllable switch is connected to the open voltage terminal, the output terminal of the controllable switch is connected to the output terminal of the second invertor and the input terminal of the fourth invertor, the output terminal of the fourth invertor is connected to the input terminal of the third invertor and the logic control module.

3. The scanning driving circuit of claim 2, wherein the logic control module comprising: a sixth to seventh controllable switch, the control terminal of the second controllable switch is connected to the second control signal and the control terminal of the seventh controllable switch, the input terminal of the second controllable switch is connected to the open voltage terminal, the output terminal of the second controllable switch is connected to the input terminal of the third controllable switch and the input terminal of the fourth controllable switch, the control terminal of the third controllable switch is connected to the output terminal of the fourth invertor and the control terminal of the fifth controllable switch, the output terminal of the third controllable switch is connected to the output module, the output terminal of the fourth controllable switch, the output terminal of the fifth controllable switch and the output terminal of the seventh controllable switch, the control terminal of the fourth controllable switch is connected to the third clock signal, the input terminal of the fifth controllable switch is connected to the output terminal of the sixth controllable switch, the control terminal of the sixth controllable switch is connected to the third clock signal, the input terminal of the sixth controllable switch is connected to the close voltage terminal and the input terminal of the seventh controllable switch.

4. The scanning driving circuit of claim 2, wherein the logic control module comprising: a sixth to seventh controllable switch, the control terminal of the second controllable switch is connected to the output terminal of the fourth invertor and the control terminal of the fifth controllable switch, the input terminal of the second controllable switch is connected to the input terminal of the third controllable switch and the open voltage terminal, the output terminal of the second controllable switch is connected to the output terminal of the third controllable switch and the input terminal of the fourth controllable switch, the control terminal of the third controllable switch is connected to the third clock signal, the control terminal of the fourth controllable switch is connected to the second control signal and the control terminal of the seventh controllable switch, the output terminal of the fourth controllable switch is connected to the output module and the output terminal of the fifth controllable switch and the seventh controllable switch, the input terminal of the fifth controllable switch is connected to the output terminal of the sixth controllable switch, the control terminal of the sixth controllable switch is connected to the third clock signal, the input terminal of the sixth controllable switch is connected to the input terminal of the seventh controllable switch and the close voltage terminal.

5. The scanning driving circuit of claim 4, wherein the output module comprising: a fifth to seventh invertor, the input terminal of the fifth invertor is connected to the output terminal of the fifth controllable switch and the seventh controllable switch, the output terminal of the fifth invertor is connected to the input terminal of the sixth invertor, the output terminal of the sixth invertor is connected to the input terminal of the seventh invertor, and the output terminal of the seventh invertor is connected to the scan line.

6. The scanning driving circuit of claim 2, wherein the logic control module comprising: a sixth to seventh controllable switch, the control terminal of the second controllable switch is connected to the output terminal of the fourth invertor and the control terminal of the sixth controllable switch, the input terminal of the second controllable switch is connected to the input terminal of the third controllable switch and the open voltage terminal, the output terminal of the second controllable switch is connected to the output terminal of the third controllable switch and the input terminal of the fourth controllable switch, the control terminal of the third controllable switch is connected to the third clock signal, the control terminal of the fourth controllable switch is connected to the second control signal and the control terminal of the seventh controllable switch, the output terminal of the fourth controllable switch is connected to the output module, and the output terminal of the fifth controllable switch and the seventh controllable switch, the input terminal of the fifth controllable switch is connected to the output terminal of the sixth controllable switch, the control terminal of the fifth controllable switch is connected to the third clock signal, the input terminal of the sixth controllable switch is connected to the input terminal of the seventh controllable switch and the close voltage terminal.

7. The scanning driving circuit of claim 6, wherein the output module comprising: a fifth to seventh invertor, the input terminal of the fifth invertor is connected to the output terminal of the fifth controllable switch and the seventh controllable switch, the output terminal of the fifth invertor is connected to the input terminal of the sixth invertor, the output terminal of the sixth invertor is connected to the input terminal of the seventh invertor, and the output terminal of the seventh invertor is connected to the scan line.

8. The scanning driving circuit of claim 2, wherein the logic control module comprising: a sixth to seventh controllable switch, the control terminal of the second controllable switch is connected to the second control signal and the control terminal of the seventh controllable switch, the input terminal of the second controllable switch is connected to the open voltage terminal, the output terminal of the second controllable switch is connected to the input terminal of the third controllable switch and the input terminal of the fourth controllable switch, the control terminal of the third controllable switch is connected to the output terminal of the fourth invertor and the control terminal of the sixth controllable switch, the output terminal of the third controllable switch is connected to the output module, the output terminal of the fourth controllable switch, the output terminal of the fifth controllable switch and the seventh controllable switch, the control terminal of the fourth controllable switch is connected to the third clock signal, the input terminal of the fifth controllable switch is connected to the output terminal of the sixth controllable switch, the control terminal of the fifth controllable switch is connected to the third clock signal, the input terminal of the sixth controllable switch is connected to the close voltage terminal and the input terminal of the seventh controllable switch.

9. The scanning driving circuit of claim 8, wherein the output module comprising: a fifth to seventh invertor, the input terminal of the fifth invertor is connected to the output terminal of the fifth controllable switch and the seventh controllable switch, the output terminal of the fifth invertor is connected to the input terminal of the sixth invertor, the output terminal of the sixth invertor is connected to the input terminal of the seventh invertor, and the output terminal of the seventh invertor is connected to the scan line.

10. The scanning driving circuit of claim 2, wherein the logic control module comprising: the control terminal of the second controllable switch is connected to the output terminal of the fourth invertor and the control terminal of the fourth controllable switch, the input terminal of the second controllable switch is connected to the input terminal of the third controllable switch and the open voltage terminal, the output terminal of the second controllable switch is connected to the output module, the output terminal of the third controllable switch and the fourth controllable switch, the control terminal of the third controllable switch is connected to the third clock signal and the control terminal of the fifth controllable switch, the input terminal of the fourth controllable switch is connected to output terminal of the fifth controllable switch, the input terminal of the fifth controllable switch is connected to the close voltage terminal.

11. The scanning driving circuit of claim 10, wherein the output module comprising: a fifth and a sixth invertor and a NOR gate, the input terminal of the fifth invertor is connected to the output terminal of the fourth controllable switch, the output terminal of the fifth invertor is connected to the first input terminal of the NOR gate, the second input terminal of the NOR gate is connected to the second control signal, the output terminal of the NOR gate is connected to the input terminal of the sixth invertor and the input terminal of the sixth invertor is connected to the scan line.

12. A liquid crystal display apparatus and the liquid crystal display apparatus having a scanning driving circuit, wherein scanning driving circuit comprising:

a latch module to receive an upper level control signal, a first and a second clock signal and a reset signal and perform a calculation to the upper level control signal, the first and the second clock signal and the reset signal to get a first control signal, and latch and output the first control signal;

a logic control module connected to the latch module to receive the first control signal output from the latch module and perform a logic calculation to the first control signal, the second control signal and the third clock signal to get a logic control signal, and output the logic control signal, wherein the logic control module comprising: a second to fifth controllable switch;

an output module connected to the logic control module to receive the logic control signal output from the logic control module and perform a calculation to the logic control signal and the second control signal to get a scanning driving signal, and output the scanning driving signal; and a scan line connected to the output module to transmit the scanning driving signal output from the output module to the pixel unit.

13. The liquid crystal display apparatus of claim 12, wherein the latch module comprising: a first to fourth invertor and a controllable switch, the input terminal of the first invertor is connected to the first clock signal, the output terminal of the first invertor is connected to the low electrical level terminal of the second invertor, the second clock signal and the high electrical level terminal of the third invertor, the input terminal of the second invertor is connected to the upper level control signal, the high electrical level terminal of the second invertor is connected to the input terminal of the first invertor and the low electrical level terminal of the third invertor, the input terminal of the third inventor is connected to the said level control signal, the control terminal of the controllable switch is connected to the reset signal, the input terminal of the controllable switch is connected to the open voltage terminal, the output terminal of the controllable switch is connected to the output terminal of the second invertor and the input terminal of the fourth invertor, the output terminal of the fourth invertor is connected to the input terminal of the third invertor and the logic control module.

14. The liquid crystal display apparatus of claim 13, wherein the logic control module comprising: a sixth to seventh controllable switch, the control terminal of the second controllable switch is connected to the second control signal and the control terminal of the seventh controllable switch, the input terminal of the second controllable switch is connected to the open voltage terminal, the output terminal of the second controllable switch is connected to the input terminal of the third controllable switch and the input terminal of the fourth controllable switch, the control terminal of the third controllable switch is connected to the output terminal of the fourth invertor and the control terminal of the fifth controllable switch, the output terminal of the third controllable switch is connected to the output module, the output terminal of the fourth controllable switch, the output terminal of the fifth controllable switch and the output terminal of the seventh controllable switch, the control terminal of the fourth controllable switch is connected to the third clock signal, the input terminal of the fifth controllable switch is connected to the output terminal of the sixth controllable switch, the control terminal of the sixth controllable switch is connected to the third clock signal, the input terminal of the sixth controllable switch is connected to the close voltage terminal and the input terminal of the seventh controllable switch.

15. The liquid crystal display apparatus of claim 13, wherein the logic control module comprising: a sixth to seventh controllable switch, the control terminal of the second controllable switch is connected to the output terminal of the fourth invertor and the control terminal of the fifth controllable switch, the input terminal of the second controllable switch is connected to the input terminal of the third controllable switch and the open voltage terminal, the output terminal of the second controllable switch is connected to the output terminal of the third controllable switch and the input terminal of the fourth controllable switch, the control terminal of the third controllable switch is connected to the third clock signal, the control terminal of the fourth controllable switch is connected to the second control signal and the control terminal of the seventh controllable switch, the output terminal of the fourth controllable switch is connected to the output module and the output terminal of the fifth controllable switch and the seventh controllable switch, the input terminal of the fifth controllable switch is connected to the output terminal of the sixth controllable switch, the control terminal of the sixth controllable switch is connected to the third clock signal, the input terminal of the sixth controllable switch is connected to the input terminal of the seventh controllable switch and the close voltage terminal.

16. The liquid crystal display apparatus of claim 13, wherein the logic control module comprising: a sixth to seventh controllable switch, the control terminal of the second controllable switch is connected to the output terminal of the fourth invertor and the control terminal of the sixth controllable switch, the input terminal of the second controllable switch is connected to the input terminal of the third controllable switch and the open voltage terminal, the output terminal of the second controllable switch is connected to the output terminal of the third controllable switch and the input terminal of the fourth controllable switch, the control terminal of the third controllable switch is connected to the third clock signal, the control terminal of the fourth controllable switch is connected to the second control signal and the control terminal of the seventh controllable switch, the output terminal of the fourth controllable switch is connected to the output module, and the output terminal of the fifth controllable switch and the seventh controllable switch, the input terminal of the fifth controllable switch is connected to the output terminal of the sixth controllable switch, the control terminal of the fifth controllable switch is connected to the third clock signal, the input terminal of the sixth controllable switch is connected to the input terminal of the seventh controllable switch and the close voltage terminal.

17. The liquid crystal display apparatus of claim 13, wherein the logic control module comprising: a sixth to seventh controllable switch, the control terminal of the second controllable switch is connected to the second control signal and the control terminal of the seventh controllable switch, the input terminal of the second controllable switch is connected to the open voltage terminal, the output terminal of the second controllable switch is connected to the input terminal of the third controllable switch and the input terminal of the fourth controllable switch, the control terminal of the third controllable switch is connected to the output terminal of the fourth invertor and the control terminal of the sixth controllable switch, the output terminal of the third controllable switch is connected to the output module, the output terminal of the fourth controllable switch, the output terminal of the fifth controllable switch and the seventh controllable switch, the control terminal of the fourth controllable switch is connected to the third clock signal, the input terminal of the fifth controllable switch is connected to the output terminal of the sixth controllable switch, the control terminal of the fifth controllable switch is connected to the third clock signal, the input terminal of the sixth controllable switch is connected to the close voltage terminal and the input terminal of the seventh controllable switch.

18. The liquid crystal display apparatus of claim 17, wherein the output module comprising: a fifth to seventh invertor, the input terminal of the fifth invertor is connected to the output terminal of the fifth controllable switch and the seventh controllable switch, the output terminal of the fifth invertor is connected to the input terminal of the sixth invertor, the output terminal of the sixth invertor is connected to the input terminal of the seventh invertor, and the output terminal of the seventh invertor is connected to the scan line.

19. The liquid crystal display apparatus of claim 13, wherein the logic control module comprising: the control terminal of the second controllable switch is connected to the output terminal of the fourth invertor and the control terminal of the fourth controllable switch, the input terminal of the second controllable switch is connected to the input terminal of the third controllable switch and the open voltage terminal, the output terminal of the second controllable switch is connected to the output module, the output terminal of the third controllable switch and the fourth controllable switch, the control terminal of the third controllable switch is connected to the third clock signal and the control terminal of the fifth controllable switch, the input terminal of the fourth controllable switch is connected to output terminal of the fifth controllable switch, the input terminal of the fifth controllable switch is connected to the close voltage terminal.

20. The liquid crystal display apparatus of claim 19, wherein the output module comprising: a fifth and a sixth invertor and a NOR gate, the input terminal of the fifth invertor is connected to the output terminal of the fourth controllable switch, the output terminal of the fifth invertor is connected to the first input terminal of the NOR gate, the second input terminal of the NOR gate is connected to the second control signal, the output terminal of the NOR gate is connected to the input terminal of the sixth invertor and the input terminal of the sixth invertor is connected to the scan line.

* * * * *